US007540720B2

(12) United States Patent
Enokijima et al.

(10) Patent No.: US 7,540,720 B2
(45) Date of Patent: Jun. 2, 2009

(54) HEAT-INSULATING MECHANISM FOR COMPRESSOR

(75) Inventors: Fuminobu Enokijima, Kariya (JP); Masaki Ota, Kariya (JP); Tetsuhiko Fukanuma, Kariya (JP); Masakazu Murase, Kariya (JP); Tatsuya Koide, Kariya (JP); Masahiro Kawaguchi, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 765 days.

(21) Appl. No.: 10/990,234

(22) Filed: Nov. 16, 2004

(65) Prior Publication Data

US 2005/0106033 A1 May 19, 2005

(30) Foreign Application Priority Data

Nov. 17, 2003 (JP) ..... 2003-387207

(51) Int. Cl.
*F04B 1/12* (2006.01)
*F04B 27/08* (2006.01)

(52) U.S. Cl. ..... 417/269; 417/312; 417/313

(58) Field of Classification Search ..... 417/269, 417/527, 313, 312, 572
See application file for complete search history.

(56) References Cited

U.S. PATENT DOCUMENTS 4,573,881 A 3/1986 Romer ..... 417/312
5,207,563 A 5/1993 Ikeda et al. ..... 417/269
5,224,840 A * 7/1993 Dreiman et al. ..... 417/312
5,556,260 A * 9/1996 Takenaka et al. ..... 417/269
6,302,658 B1 10/2001 Seipel et al. ..... 417/269
6,457,947 B1 * 10/2002 Seipel et al. ..... 417/269

FOREIGN PATENT DOCUMENTS

JP 2-264163 10/1990
JP 6-317249 11/1994
JP WO 99/11929 3/1999

* cited by examiner

*Primary Examiner*—Charles G Freay
*Assistant Examiner*—Peter J Bertheaud
(74) *Attorney, Agent, or Firm*—Locke Lord Bissell & Liddell LLP

(57) ABSTRACT

A heat-insulating mechanism in a compressor which introduces refrigerant gas from a suction pressure region to a compression chamber and discharges the refrigerant gas from the compression chamber to a discharge pressure region has a circular passage, a communication passage, a cylindrical member and a passage heat-insulating member. The circular passage, which is a portion of the suction pressure region, has a circular cross-section, and is in communication with an external refrigerant circuit. The communication passage, which is a portion of the suction pressure region, intersects the circular passage for connection therewith, and is communicable with the compression chamber. The cylindrical member is fitted into the circular passage. The passage heat-insulating member made of an insulating material covers at least a portion of a passage wall surface which forms the communication passage. Rotation of the cylindrical member is prevented by engaging the passage heat-insulating member with the cylindrical member.

9 Claims, 6 Drawing Sheets

HEAT-INSULATING MECHANISM FOR COMPRESSOR

BACKGROUND OF THE INVENTION

The present invention relates to a heat-insulating mechanism for a compressor which introduces refrigerant gas from a suction pressure region into a compression chamber and discharges the refrigerant gas from the compression chamber to a discharge pressure region.

The temperature of refrigerant gas introduced from the outside of a compressor into a suction pressure region of the compressor influences the performance of the compressor. As the temperature of the refrigerant gas introduced into the suction pressure region rises, the density of the refrigerant gas to be introduced into a compression chamber reduces, with the consequence of deteriorated performance of the compressor.

In the compressor disclosed in Unexamined Japanese Patent Publication No. 2-264163, a rear cover forms therein a suction passage for introducing refrigerant gas therethrough into a suction chamber which is a part of a suction pressure region of the compressor, and a cylindrical conduit is inserted into the suction passage. The refrigerant gas is introduced into the suction chamber through an inner passage of the conduit.

When the amount of heat transmitted from the rear cover to the conduit is large, the temperature of refrigerant gas in the inner passage of the conduit rises, and the high-temperature refrigerant gas is introduced into the compression chamber through the suction chamber. This deteriorates the performance of the compressor. A clearance is formed between the outer peripheral wall surface of the conduit and the peripheral wall surface of the suction passage for controlling the heat transmitted from the rear cover to the conduit. However, the provision of the clearance alone is not enough to accomplish a high adiabatic efficiency. Therefore, there is a need for enhancing the adiabatic efficiency in the suction pressure region of the compressor.

SUMMARY OF THE INVENTION

In accordance with the present invention, a heat-insulating mechanism in a compressor which introduces refrigerant gas from a suction pressure region to a compression chamber and discharges the refrigerant gas from the compression chamber to a discharge pressure region has a circular passage, a communication passage, a cylindrical member and a passage heat-insulating member. The circular passage, which is a portion of the suction pressure region, has a circular cross-section, and is in communication with an external refrigerant circuit. The communication passage, which is a portion of the suction pressure region, intersects the circular passage for connection therewith, and is communicable with the compression chamber. The cylindrical member is fitted into the circular passage. The passage heat-insulating member made of an insulating material covers at least a portion of a passage wall surface which forms the communication passage. Rotation of the cylindrical member is prevented by engaging the passage heat-insulating member with the cylindrical member.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims.

The invention together with objects and advantages thereof, may best be understood by reference to the following description of the presently preferred embodiments together with the accompanying drawings in which.

DETAILED DESCRIPTION OF THE PREFERRED EMBODIMENTS

A first preferred embodiment of a variable displacement piston type compressor 16 according to the present invention will now be described with reference to FIGS. 1 through 6B.

Figure 1:
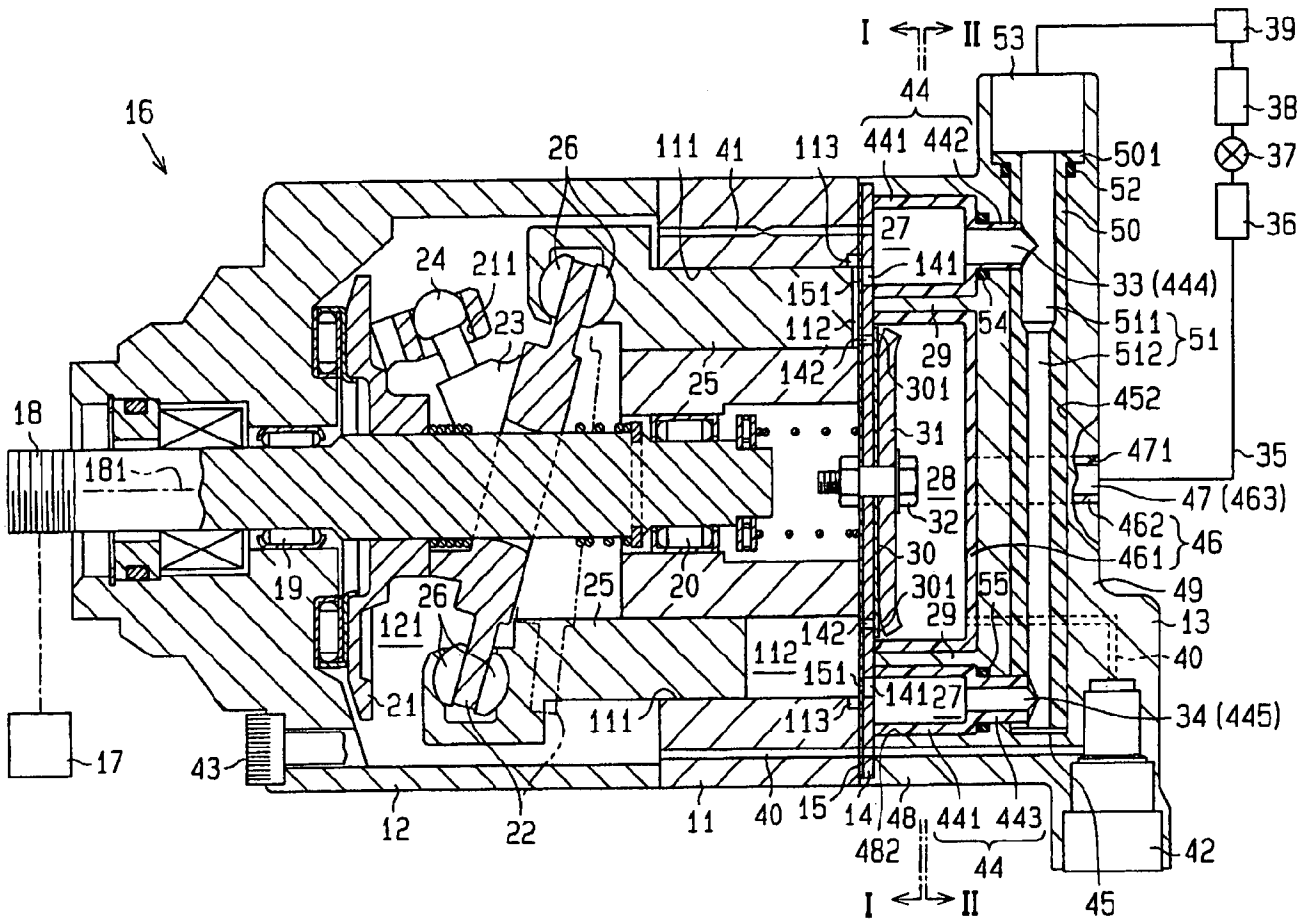
FIG. 1 is a longitudinal cross-sectional view of a compressor according to a first preferred embodiment of the present invention.
Figure 5:
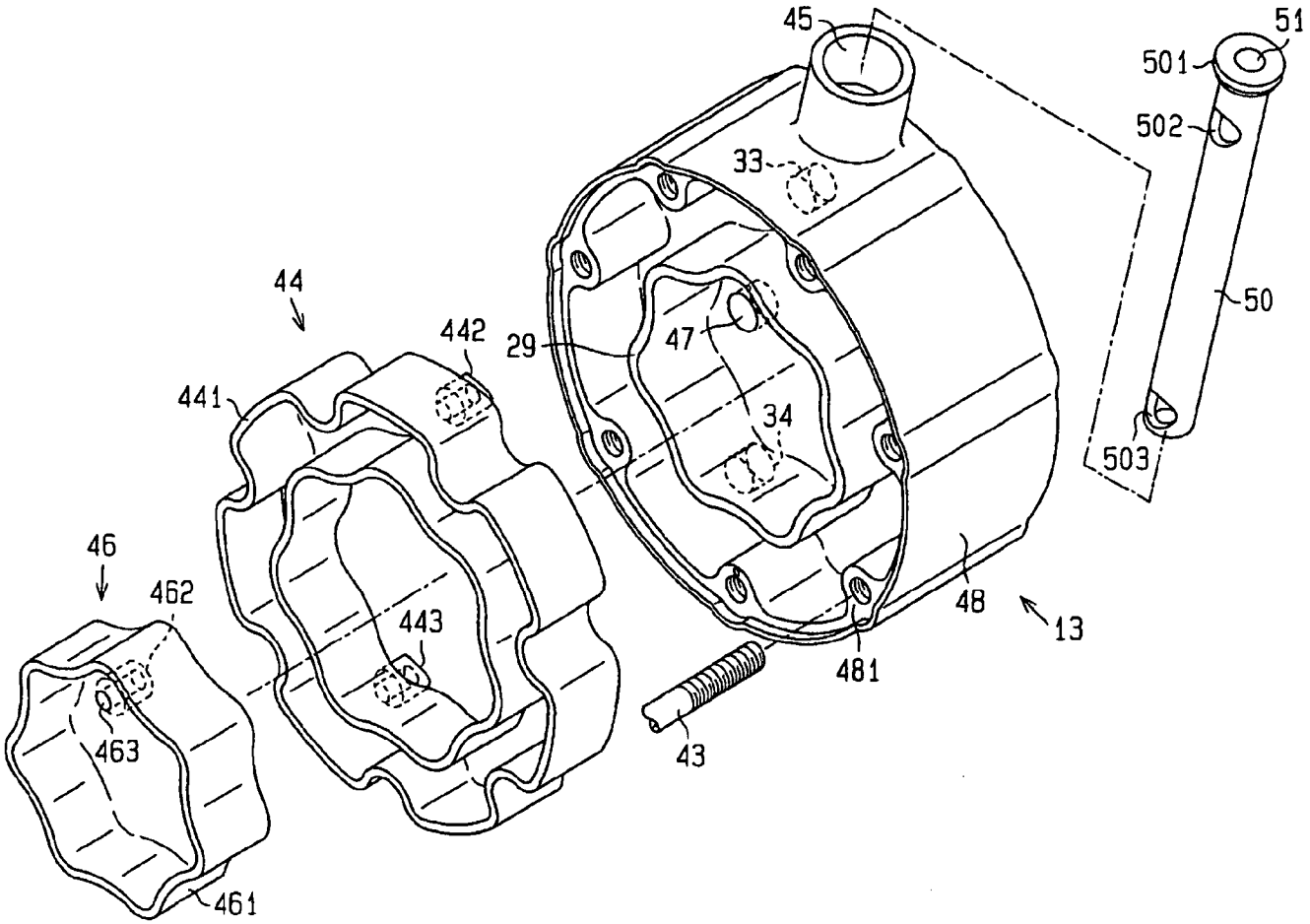
FIG. 5 is an exploded perspective view according to the first preferred embodiment of the present invention.

As shown in FIG. 1, the compressor 16 includes an aluminum front housing 12 which is fixedly connected to the front end of an aluminum cylinder 11 and an aluminum rear housing or a cover housing 13 which is fixedly connected to the rear end of the cylinder 11 through a valve port plate 14 and a valve plate 15. The cylinder 11, the front housing 12 and the rear housing 13 are fastened together by bolts 43. As shown in FIG. 5, the rear housing 13 has an outer peripheral wall, 48 forming therein a plurality of threaded holes 481 each receiving 10 therein a bolt 43. The cylinder 11, the front housing 12 and the rear housing 13 cooperatively form the housing of the variable displacement piston type compressor 16.

As shown in FIG. 1, the front housing 12 and the cylinder 11 form a crank chamber 121, and a rotary shaft 18 is rotatably supported by the front housing 12 and the cylinder 11 through radial bearings 19 and 20. The rotary shaft 18 protruding outside from the crank chamber 121 receives driving power from a vehicle engine or an external power source 17 through a pulley (not shown) and a belt (not shown).

A rotor 21 is fixedly connected to the rotary shaft 18, while a swash plate 22 is supported so as to be slidable in the axial direction of the rotary shaft 18 and inclinable relative to the rotary shaft 18. A pair of coupling elements 23 is fixedly connected to the swash plate 22, and a guide pin 24 is fixedly connected to each connecting element 23. The rotor 21 forms therein a pair of guide holes 211, and the head of the guide pin 24 is slidably fitted into each guide hole 211. The swash plate 22 is slidable in the axial direction of the rotary shaft 18 and is rotatable integrally with the rotary shaft 18 due to coordinated movements of the guide holes 211 and the guide pins 24. The inclination of the swash plate 22 is guided by a slide-guide between the guide hole 211 and the guide pin 24 and a slide-support of the rotary shaft 18.

As the center of the swash plate 22 moves toward the rotor 21, the inclination angle of the swash plate 22 increases. The maximum inclination angle of the swash plate 22 is regulated by the contact between the rotor 21 and the swash plate 22.

The position of the swash plate 22 indicated by the solid line in FIG. 1 shows a state of the maximum inclination angle of the swash plate 22. As the center of the swash plate 22 moves toward the cylinder 11, the inclination angle of the swash plate 22 reduces. The position of the swash plate 22 indicated by the dotted line in FIG. 1 shows a state of the minimum inclination angle of the swash plate 22.

A plurality of cylinder bores 111 is formed extending through the cylinder 11 and a piston 25 is received in each of the cylinder bores 111. Rotation of the swash plate 22 is converted to reciprocation of the piston 25 in the cylinder bore 111 through a pair of shoes 26. The piston 25 defines a compression chamber 112 in the cylinder bore 111.

Figure 2:
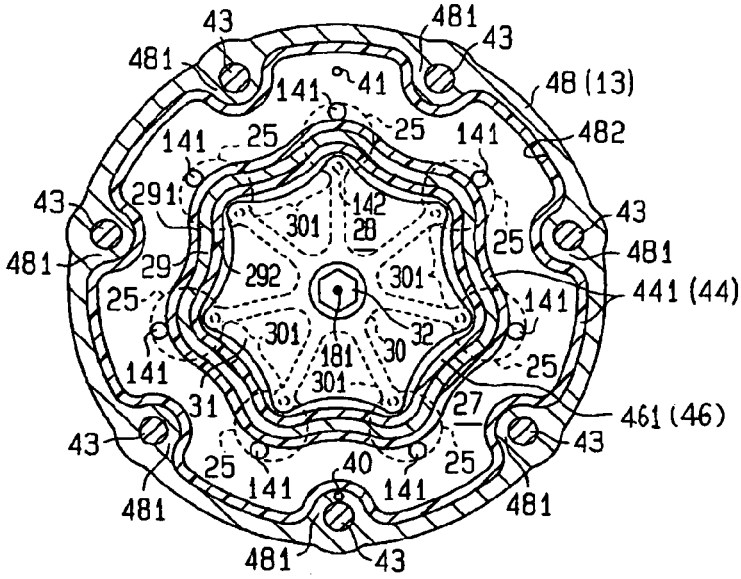
FIG. 2 is a cross-sectional view that is taken along the line I-I in FIG. 1.
Figure 3:
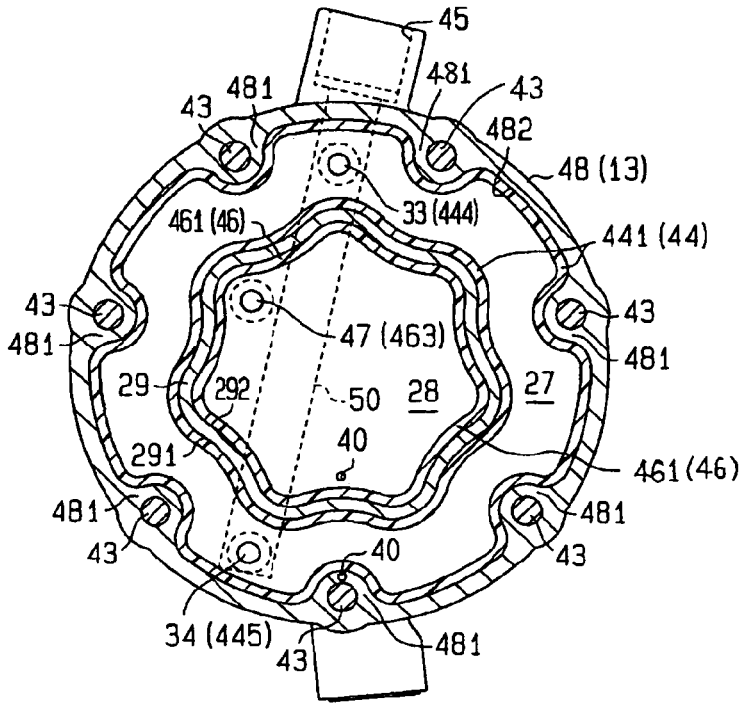
FIG. 3 is a cross-sectional view that is taken along the line II-II in FIG. 1.

As shown in FIGS. 1 through 3, the rear housing 13 forms therein a suction chamber 27 and a discharge chamber 28 which are separated by an annular partition wall 29. The suction chamber 27, that is, a part of the suction pressure region of the compressor, is located on the radially outer side of the rear housing 13, surrounding the discharge chamber 28, that is, a part of the discharge pressure region around the axis 181 of the rotary shaft 18. As shown in FIG. 1, a valve plate 30 and a retainer 31 are fastened to the valve port plate 14 in the discharge chamber 28 by a screw 32.

As shown in FIG. 1, the valve port plate 14 forms therein suction ports 141 and discharge ports 142. The valve plates 15 and 30 form therein suction valves 151 and discharge valves 301, respectively. As the piston 25 moves leftward from its top dead center as seen in FIG. 1, gaseous refrigerant in the suction chamber 27 is drawn into the compression chamber 112 through the suction port 141 while pushing the suction valve 151 open. The opening degree of the suction valve 151 is regulated by the bottom of a retaining recess 113 formed in the cylinder 11. As the piston 25 moves rightward from its bottom dead center as seen in FIG. 1, on the other hand, gaseous refrigerant in the compression chamber 112 is discharged into the discharge chamber 28 through the discharge port 142 while pushing the discharge valve 301 open. The opening degree of the discharge valve 301 is regulated by the retainer 31.

The rear housing 13 has an end wall 49 in which an insertion opening 53, a circular passage 45, a first communication passage 33, a second communication passage 34 and a discharge passage 47 are formed. The first communication passage 33 and the second communication passage 34, which are part of the suction pressure region, are in communication with the suction chamber 27, which is also a part of the suction pressure region. The discharge passage 47 is in communication with the discharge chamber 28. The first communication passage 33 and the second communication passage 34 extend in a direction which is parallel to the axis 181 of the rotary shaft 18.

The circular passage 45, which is a part of the suction pressure region, has a circular cross-section and extends linearly from one outer peripheral portion of the rear housing 13 toward the opposite outer peripheral portion thereof. The circular passage 45 extends perpendicularly to the axis 181 of the rotary shaft 18. The first communication passage 33 extends in parallel to the axis 181 of the rotary shaft 18 and intersects the circular passage 45 near the proximal end (the upper side in FIG. 1) for connection therewith. The second communication passage 34 also extends in parallel to the axis 181 of the rotary shaft 18 and intersects the circular passage 45 near the distal end (the lower side in FIG. 1) for connection therewith.

The circular passage 45 for introducing gaseous refrigerant into the suction chamber 27 and the discharge passage 47 for discharging gaseous refrigerant from the discharge chamber 28 are in communication through an external refrigerant circuit 35. A heat exchanger 36 for radiating heat from refrigerant, a fixed throttle 37, a heat exchanger 38 for transferring ambient heat to refrigerant, and an accumulator 39 are provided in the external refrigerant circuit 35. The accumulator 39 serves to send only gaseous refrigerant to the compressor. Refrigerant in the discharge chamber 28 flows through the discharge passage 47, the heat exchanger 36, the fixed throttle 37, the heat exchanger 38, the accumulator 39, the circular passage 45, the first communication passage 33 and the second communication passage 34 into the suction chamber 27.

The discharge chamber 28 and the crank chamber 121 are in communication through a supply passage 40. The crank chamber 121 and the suction chamber 27 are in communication through a bleed passage 41. Refrigerant in the crank chamber 121 flows through the bleed passage 41 into the suction chamber 27.

An electromagnetic control valve 42 is disposed in the supply passage 40. When de-energized, the control valve 42 is in closed state where refrigerant is not allowed to flow, so that refrigerant is not supplied from the discharge chamber 28 through the supply passage 40 to the crank chamber 121. Since refrigerant in the crank chamber 121 flows out thereof through the bleed passage 41 to the suction chamber 27, the pressure in the crank chamber 121 decreases. Accordingly, the inclination angle of the swash plate 22 increases thereby to increase the displacement of the compressor. When energized, the control valve 42 is in opened state where refrigerant is allowed to flow, so that refrigerant is supplied from the discharge chamber 28 through the supply passage 40 to the crank chamber 121. Thus, the pressure in the crank chamber 121 increases to reduce the inclination angle of the swash plate 22 thereby to reduce the displacement of the compressor.

Figure 4:
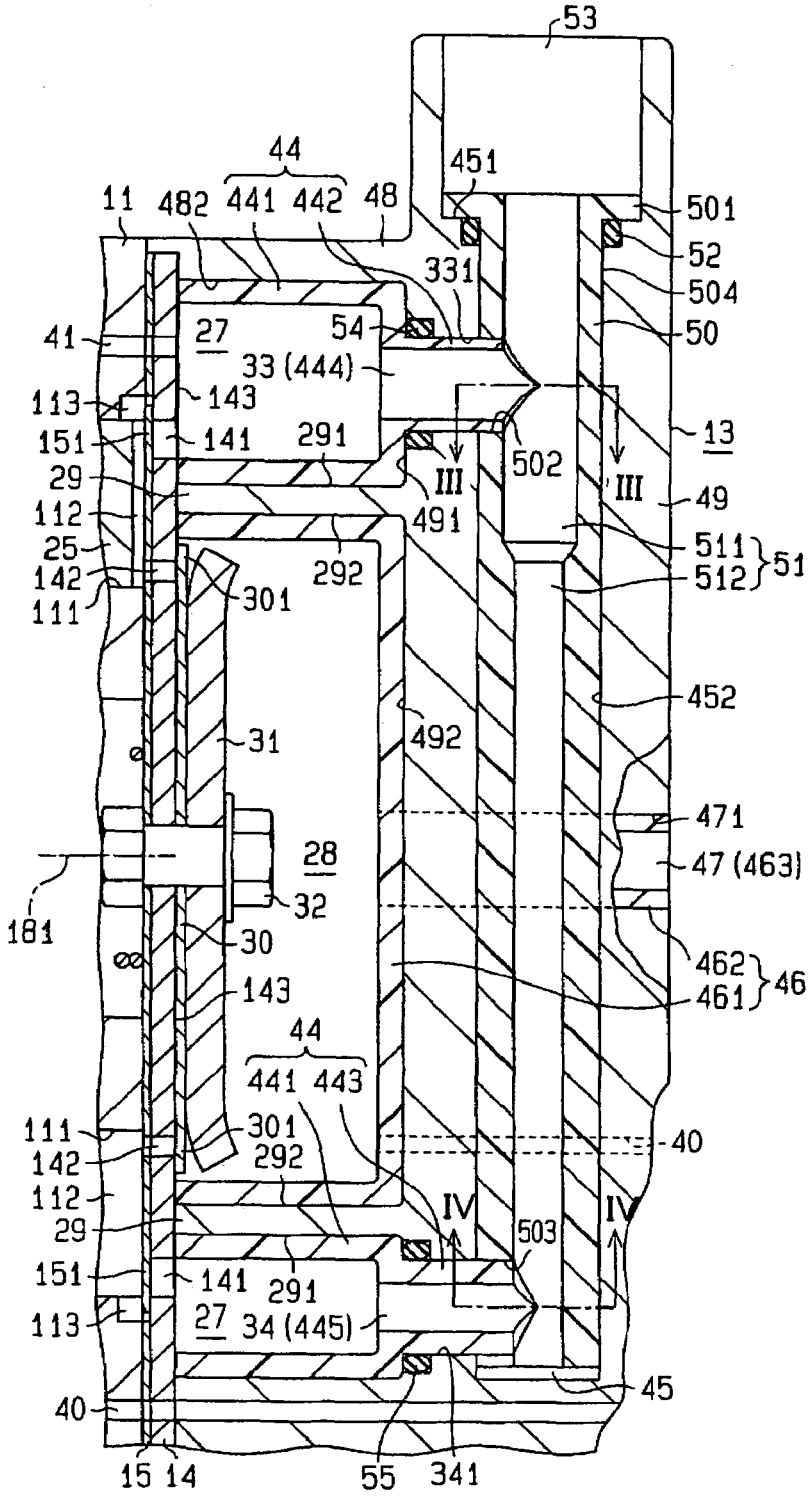
FIG. 4 is a partially enlarged longitudinal cross-sectional view according to the first preferred embodiment of the present invention.

As shown in FIG. 4, a heat-insulating member 44 is inserted in the suction chamber 27. The heat-insulating member 44 includes a chamber heat-insulating member 441 and passage heat-insulating members 442, 443. The chamber heat-insulating member 441 is disposed so as to cover an inner wall surface 482 of the outer peripheral wall 48, an inner wall surface 491 of the end wall 49 and an outer peripheral wall surface 291 of the partition wall 29. The passage heat-insulating members 442 and 443 are provided so as to cover passage wall surfaces 331 and 341 forming the first and second communication passages 33 and 34, respectively. That is, the heat-insulating member 44 covers the wall surfaces (the inner wall surfaces 482, 491, the outer peripheral wall surface 291 and the passage wall surfaces 331, 341) forming the suction pressure region constituted of the suction chamber 27, the first communication passage 33 and the second communication passage 34. A surface 143 of the valve port plate 14 facing the suction chamber 27 is a part of the wall surface forming the suction pressure region.

A heat-insulating member 46 is inserted in the discharge chamber 28. The heat-insulating member 46 includes a chamber heat-insulating member 461 and a passage heat-insulating member 462. The chamber heat-insulating member 461 is provided so as to cover an inner wall surface 492 of the end wall 49 and an inner peripheral wall surface 292. The passage heat-insulating member 462 is disposed so as to cover a peripheral wall surface 471 forming the discharge passage 47. That is, the heat-insulating member 46 covers the wall surface (the inner wall surface 492, 292 and the peripheral wall surface 471) forming the discharge pressure region constituted of the discharge chamber 28 and the discharge passage 47.

The surface 143 of the valve port plate 14 facing the discharge chamber 28 is a part of the wall surface for forming the discharge pressure region.

As shown in FIG. 4, a cylindrical member 50 made of insulating material is loosely fitted into the circular passage 45. The linear cylindrical member 50 is formed at its proximal end with a flange 501. The flange 501 contacts a step 451 between the insertion opening 53 and the circular passage 45 thereby to regulate the position of the cylindrical member 50 inserted into the circular passage 45. The cylindrical member 50 covers most of a peripheral wall surface 452 which forms the circular passage 45.

The cylindrical member 50 defines therein an internal passage 51 which includes a first passage 511 and a second passage 512 which is smaller in diameter than the first passage 511. The second passage 512 is located downstream of the first passage 511 as seen in the direction in which the refrigerant flows.

As shown in FIGS. 4, 5, 6A and 6B, the cylindrical member 50 forms in the peripheral wall thereof communication holes 502, 503 as communicating portions. The communication hole 502 is in communication with the first passage 511, while the communication hole 503 is in communication with the second passage 512.

Figure 6A:
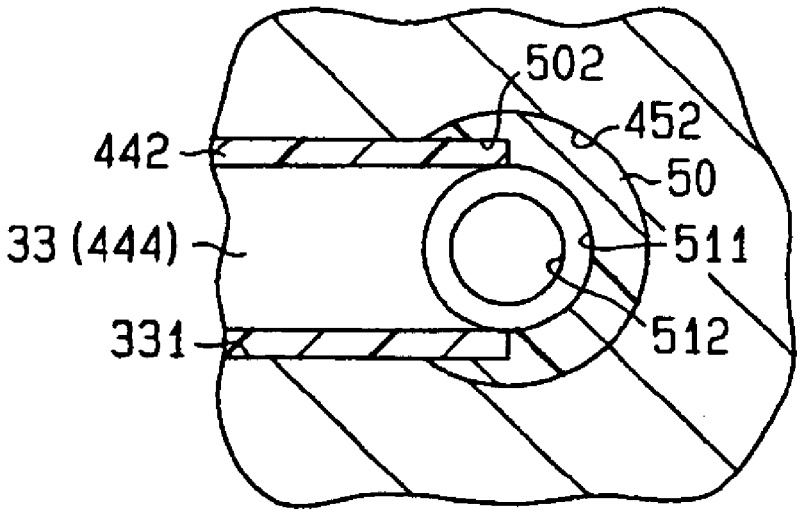
FIG. 6A is a cross-sectional view that is taken along the line III-III in FIG. 4.

As shown in FIGS. 4 and 6A, the passage heat-insulating member 442 of the heat-insulating member 44 is fitted into (or engaged with) the communication hole 502, and an internal passage 444 of the passage heat-insulating member 442 is in communication with the first passage 511. The diameter of the communication hole 502 is substantially the same as the outer diameter of the passage heat-insulating member 442, so that the passage heat-insulating member 442 is tightly fitted into the communication hole 502. The diameter of the internal passage 444 is substantially the same as the diameter of the first passage 511. That is, the cross-sectional area of the internal passage 444 corresponds to that of the first passage 511.

The internal passage 51 (the circular passage 45) of the cylindrical member 50 is located downstream of the external refrigerant circuit 35 with respect to the flow of refrigerant for communication therewith. The internal passage 444 (the first communication passage 33) which intersects the internal passage 51 (the circular passage 45) for connection therewith is communicable with the compression chamber 112 through the suction chamber 27 and the suction port 141.

Figure 6B:
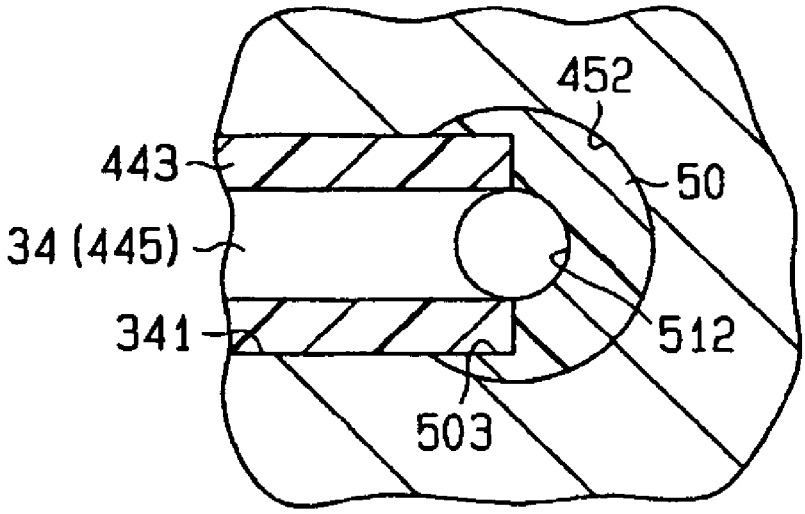
FIG. 6B is a cross-sectional view that is taken along the line IV-IV in FIG. 4.

As shown in FIGS. 4 and 6B, the passage heat-insulating member 443 of the heat-insulating member 44 is fitted into (or engaged with) the communication hole 503, and an internal passage 445 of the passage heat-insulating member 443 is in communication with the second passage 512. The diameter of the communication hole 503 is substantially the same as the outer diameter of the passage heat-insulating member 443, so that the passage heat-insulating member 443 is tightly fitted into the communication hole 503. The diameter of the internal passage 445 is substantially the same as that of the second passage 512. That is, the cross-sectional area of the internal passage 445 is substantially the same as that of the second passage 512.

A seal ring 52 is provided upstream of the communication hole 502 between an outer peripheral wall surface 504 of the cylindrical member 50 and the peripheral wall surface 452 of the circular passage 45. Seal rings 54, 55 are provided between the outer peripheral wall surfaces of the passage heat-insulating members 442, 443 and the passage wall surfaces 331, 341 of the communication passages 33, 34, respectively.

In the first preferred embodiment, the heat-insulating members 44, 46 and the cylindrical member 50 are made of synthetic resin. Carbon dioxide is employed as refrigerant.

According to the first preferred embodiment, the following advantageous effects are obtained.

(1-1) In operation of the variable displacement piston type compressor 16, the discharge chamber 28 and the discharge passage 47 where compressed refrigerant gas exists become higher in temperature, so that the temperature of the rear housing 13 rises. The cylindrical member 50, which covers the peripheral wall surface 452 which forms the circular passage 45 of the suction pressure region, is made of synthetic resin having a small thermal conductivity. The cylindrical member 50 reduces the heat transmitted from the aluminum rear housing 13 having a large thermal conductivity to refrigerant gas in the circular passage 45 (that is, refrigerant gas in the internal passage 51 of the cylindrical member 50).

The cylindrical member 50, which is loosely fitted into the circular passage 45, may be rotated in or moved along the circular passage 45. The rotation of the cylindrical member 50 causes poor connection between the internal passages 444, 445 of the respective passage heat-insulating members 442, 443 and the internal passage 51 of the cylindrical member 50. The movement of the cylindrical member 50 along the circular passage 45 also causes poor connection between the internal passages 444, 445 of the respective passage heat-insulating members 442, 443 and the internal passage 51 of the cylindrical member 50. Then, refrigerant gas in the cylindrical member 50 flows out through the poor connection in the communication hole 502 into a gap between the outer periphery of the cylindrical member 50 and the peripheral wall surface 452 of the circular passage 45. The refrigerant gas thus flowing into the gap directly receives heat from the peripheral wall surface 452 of the circular passage 45 and, therefore, becomes higher in temperature than refrigerant gas in the internal passage 51. The refrigerant gas having a higher temperature than the refrigerant gas in the internal passage 51 flows through the poor connection in the communication hole 503 into the internal passage 51 of the cylindrical member 50, and this refrigerant gas may flow into the compression chamber 112 through the suction chamber 27. This leads to a decrease in adiabatic efficiency in the circular passage 45 and the communication passages 33, 34 which are part of the suction pressure region, with the consequence of deteriorated performance of the compressor.

In the first preferred embodiment, since the passage heat-insulating members 442, 443 are tightly fitted into the communication holes 502, 503 formed in the peripheral wall of the cylindrical member 50, the cylindrical member 50 neither rotates in nor moves along the circular passage 45. Accordingly, no poor connection is made between the internal passages 444, 445 of the respective passage heat-insulating members 442, 443 and the internal passage 51 of the cylindrical member 50.

(1-2) The cylindrical member 50 is loosely fitted into the circular passage 45. Such structure does not require strict adjustment between the shape of the peripheral wall surface 452 forming the circular passage 45 and the outer peripheral shape of the cylindrical member 50. This allows a large tolerance of the cylindrical member 50 in assembling thereof to the rear housing 13, so that machining of the circular passage 45 and the cylindrical member 50 is facilitated.

(1-3) The passage heat-insulating members 442, 443 made of insulating material regulate the heat transmitted from the rear housing 13 to refrigerant gas in the first communication passage 33 (that is, the internal passage 444) and in the second communication passage 34 (that is, the internal passage 445).

(1-4) The suction chamber 27 of the suction pressure region is located on the outer peripheral side of the rear housing 13, while the discharge chamber 28 of the discharge pressure region is located around the axis 181 of the rotary shaft 18 and is surrounded by the suction chamber 27. The structure in which the suction chamber 27 is located on the outer peripheral side of the rear housing 13 (or on the side closer to the atmosphere) is advantageous in preventing refrigerant gas in the suction chamber 27 from being heated.

(1-5) The first communication passage 33 intersects the circular passage 45 near the proximal end for connection therewith, while the second communication passage 34 intersects the circular passage 45 near the distal end which is located downstream of the communicating portion (that is, the communication hole 502) between the circular passage 45 and the first communication passage 33 for communication with the circular passage 45 near the distal end. The first communication passage 33 and the second communication passage 34 are located on the radially opposite sides of the discharge chamber 28 and in communication with the suction chamber 27, respectively. In the variable displacement piston type compressor 16, a plurality of the cylinder bores 111 is provided around the rotary shaft 18, and the piston 25 received in each cylinder bore 111 defines the compression chamber 112 in each cylinder bore 111. The above structure is effective in making the amount of refrigerant gas drawn into the respective compression chambers 112 uniform. Such structure that a pair of the communication passages 33, 34 is covered with the passage heat-insulating members 442, 443 enhances adiabatic efficiency in the communication passages 33, 34.

(1-6) As the flow rate of refrigerant gas in the internal passage 51 of the cylindrical member 50 decreases, the amount of heat transmitted from the cylindrical member 50 to the refrigerant gas increases, so that adiabatic efficiency decreases. Supposing that the diameter of the internal passage 51 of the cylindrical member 50 is constant, the flow rate of refrigerant gas in the internal passage 51 decreases downstream of the communicating portion (that is, the communication hole 502) between the first communication passage 33 and the internal passage 51. The structure according to which the internal passage 51 is formed so as to include the larger diameter first passage 511 and the smaller diameter second passage 512 which is located downstream of the first passage 511 is effective in preventing decrease in the flow rate of gas in the internal passage 51 downstream of the communicating portion (the communication hole 502) between the first communication passage 33 and the internal passage 51.

Furthermore, the internal passage 444 in the passage heat-insulating member 442 is formed to have the same diameter as the first passage 511, while the diameter of the internal passage 445 in the passage heat-insulating member 443 is adjusted to have the same diameter as the second passage 512, and the internal passage 444 is formed with a diameter which is a little larger than the diameter of the internal passage 445. Therefore, the flow rate of gas in the first communication passage 33 (the internal passage 444) is substantially the same as the flow rate of gas in the second communication passage 34 (the internal passage 445), so that a decrease in the flow rate of gas is prevented in the second communication passage 34 (the internal passage 445) which is located downstream of the second passage 512.

(1-7) The seal ring 52 provided between the outer peripheral wall surface 504 of the cylindrical member 50 and the peripheral wall surface 452 of the circular passage 45 regulates the flowing of refrigerant gas therebetween. Therefore, the amount of heat directly transmitted from the peripheral wall surface 452 of the circular passage 45 to refrigerant gas is lessened. Thus, the seal ring 52 contributes to improving adiabatic efficiency in the circular passage 45.

(1-8) The heat-insulating member 44, which covers the wall surfaces (the inner wall surfaces 482, 491, the outer peripheral wall surface 291 and the passage wall surfaces 331, 341) which form the suction pressure region, reduces the heat transmitted from the rear housing 13 to refrigerant gas in the suction pressure region (the suction chamber 27 and the communication passages 33, 34). This contributes to improving the performance of the compressor.

(1-9) When the heat-insulating member 44 is loosely fitted into the suction chamber 27, a gap is formed between the heat-insulating member 44 and these outer peripheral wall 48, end wall 49 and partition wall 29, respectively. Where refrigerant gas is introduced through this gap into the compression chamber 112, refrigerant gas to which heat is directly transmitted from these outer peripheral wall 48, end wall 49 and partition wall 29 is introduced into the compression chamber 112. This leads to deteriorated performance of the compressor.

The structure in which the chamber heat-insulating member 441 and the passage heat-insulating members 442, 443 are integrally formed is effective in preventing refrigerant gas from flowing into a gap between the heat-insulating member 44 and each of these outer peripheral wall 48, end wall 49 and partition wall 29.

(1-10) The heat-insulating member 46 made of synthetic resin and covering the wall surfaces (the inner wall surface 492, the inner peripheral wall surface 292 and the peripheral wall surface 471) which form the discharge pressure region, reduces the heat transmitted from refrigerant gas in the discharge pressure region (the discharge chamber 28 and the discharge passage 47) to the rear housing 13. The reduction in the heat transmitted from refrigerant gas in the discharge pressure region to the rear housing 13 leads to preventing heat from being transmitted from the rear housing 13 to refrigerant gas in the suction pressure region.

(1-11) The seal rings 54, 55 prevent refrigerant gas from flowing between the heat-insulating member 44 and the wall surfaces (the inner wall surfaces 482, 491, the outer peripheral wall surface 291 and the passage wall surface 331) which form the suction pressure region. This prevention of such flow of refrigerant gas reduces the amount of heat directly transmitted from the rear housing 13 to refrigerant gas, so that adiabatic efficiency in the suction pressure region of the variable displacement piston type compressor 16 is enhanced. This contributes to improving the performance of the variable displacement piston type compressor 16.

(1-12) The use of carbon dioxide as refrigerant under the condition of higher pressure than chlorofluorocarbon gas permits reduced flow rate of refrigerant gas. As the flow rate of gas decreases, it becomes more important to provide for preventing refrigerant gas from being heated in the suction pressure region. The present invention is advantageously applicable to a compressor designed to use carbon dioxide as refrigerant, such as the variable displacement piston type compressor 16 shown in the drawings.

Figure 7:
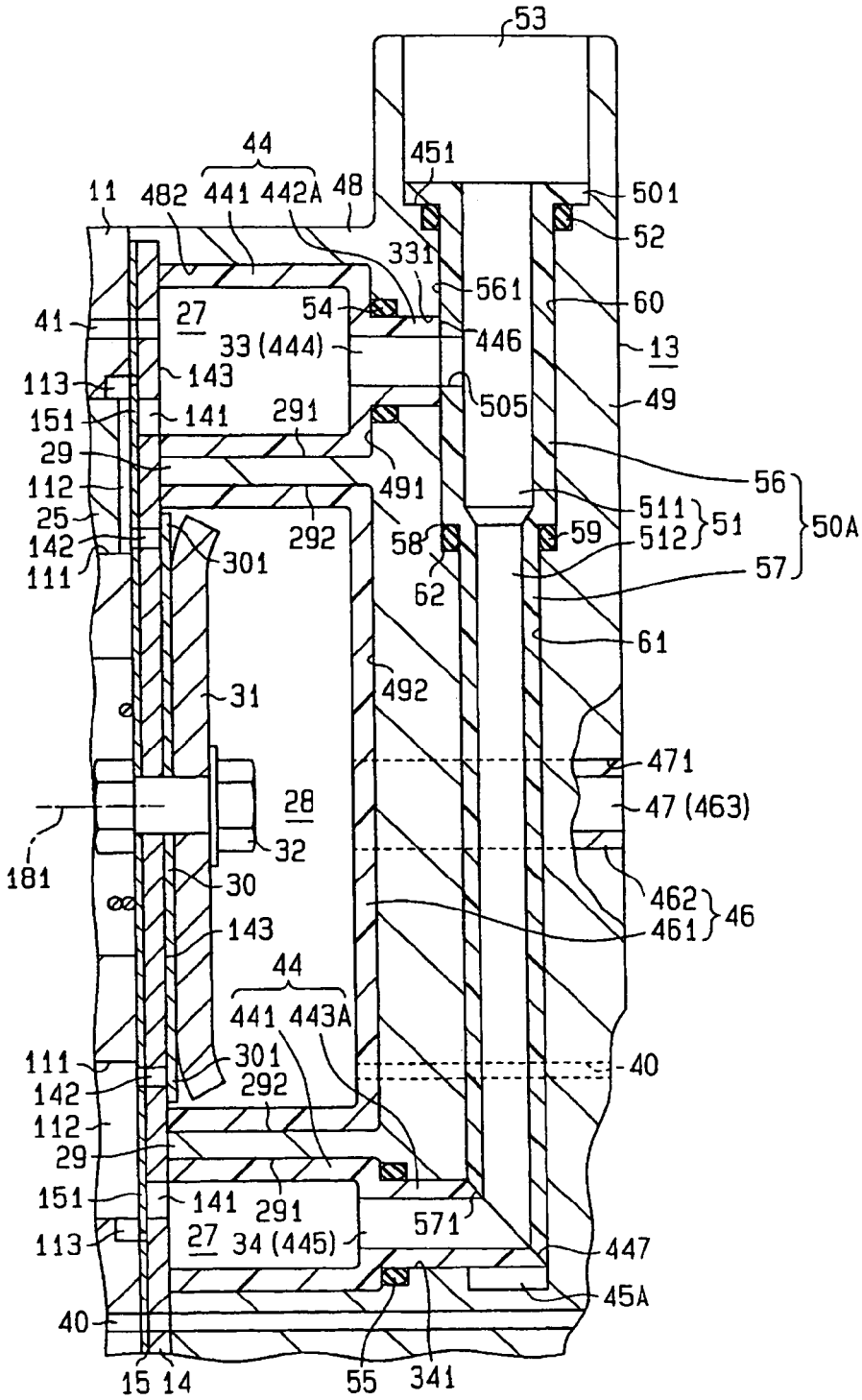
FIG. 7 is a partially longitudinal cross-sectional view according to a second preferred embodiment of the present invention.

A second preferred embodiment of the present invention will now be described with reference to FIG. 7. The same reference numerals denote the substantially identical components or elements to those of the first preferred embodiment.

A cylindrical member 50A which is made of insulating material and includes a cylindrical portion 56 corresponding to the first passage 511 and another cylindrical portion 57 corresponding to the second passage 512 is loosely fitted into a circular passage 45A. The outer diameter of the cylindrical portion 57 is smaller than that of the cylindrical portion 56. A passage heat-insulating member 442A has an end 446 which is connected to an outer peripheral wall surface 561 of the cylindrical portion 56 such that the internal passage 444 communicates with a communication hole 505. The inner diameter of the passage heat-insulating member 442A (the diameter of the internal passage 444) is substantially the same as the diameter of the communication hole 505.

The cylindrical portion 571 has a distal end 571 which is beveled at an angle of 45 degrees. The passage heat-insulating member 443A has an end 447 which is also beveled at 45 degrees, The cylindrical portion 57 and the passage heat-insulating member 443A are connected together at their respective beveled ends 571, 447 so as to form an L joint as shown in FIG. 7. The outer diameter of the cylindrical portion 57 is substantially the same as that of the passage heat-insulating member 443A, and the inner diameter of the cylindrical portion 57 is also substantially the same as that of the passage heat-insulating member 443A (the diameter of the internal passage 445). Also, the inner diameter of the passage heat-insulating member 442A (the diameter of the internal passage 444) is substantially the same as that of the passage heat-insulating member 443A (the diameter of the internal passage 445).

The circular passage 45A is formed by a larger-diameter peripheral wall surface 60 corresponding to the cylindrical portion 56 and a smaller-diameter peripheral wall surface 61 corresponding to the cylindrical portion 57. A seal ring 59 is interposed between a step 62 formed between the peripheral wall surface 60 and the smaller diameter peripheral wall surface 61, and a step 58 formed between the cylindrical portion 56 and the cylindrical portion 57. The seal ring 59 is located downstream of the communication hole 505 with respect to the flowing direction of refrigerant gas.

In the second preferred embodiment, connection (or engagement) between the end 447 of the passage heat-insulating member 443A and the distal end 571 of the cylindrical portion 57 prevents the rotation of the cylindrical member 50A. The seal ring 59 prevents refrigerant gas from flowing between the peripheral wall surfaces 60, 61 of the circular passage 45 and the outer peripheral wall surface of the cylindrical member 50A.

Furthermore, the internal passage 445 in the passage heat-insulating member 443A is formed with a diameter which is substantially the same as the diameter of the second passage 512, while the diameter of the internal passage 444 in the passage heat-insulating member 442A is substantially the same as the diameter of the internal passage 445. Therefore, the flow rate of gas in the first communication passage 33 (the internal passage 444) is substantially the same as the flow rate of gas in the second communication passage 34 (the internal passage 445), so that a decrease in the flow rate of gas in the second communication passage 34 (the internal passage 445), which is located downstream of the second passage 512, is prevented.

The present invention is not limited to the embodiments described above but may be modified into the following alternative embodiments.

(1) In the first preferred embodiment, one of communication passages 33, 34 may be omitted.

(2) The chamber heat-insulating member 441 may be independently formed from the passage heat-insulating members 442, 443. Such structure does not allow the passage heat-insulating members 442, 443 to rotate.

(3) The cylindrical members 50, 50A may be made of a hard rubber.

(4) The heat-insulating members 44, 46 may be made of a hard rubber.

(5) The present invention may be applied to a piston type compressor which includes a discharge pressure region located on the radially outer side of the rear housing 13 and a suction pressure region surrounded by the discharge pressure region around the axis 181 of the rotary shaft 18.

(6) The present invention may be applied to a compressor other than a piston type compressor.

(7) The present invention may be applied to a fixed displacement type compressor.

(8) The present invention may be applied to a compressor which employs refrigerant other than carbon dioxide.

Therefore, the present examples and embodiments are to be considered as illustrative and not restrictive, and the invention is not to be limited to the details given herein but may be modified within the scope of the appended claims.

What is claimed is:

1. A heat-insulating mechanism in a compressor which introduces refrigerant gas from a suction pressure region to a compression chamber and discharges the refrigerant gas from the compression chamber to a discharge pressure region, comprising:

a circular passage, which is a portion of the suction pressure region, having a circular cross-section, the circular passage being in communication with an external refrigerant circuit;

a communication passage, which is a portion of the suction pressure region, intersecting the circular passage for connection therewith, the communication passage being communicable with the compression chamber;

a cylindrical member rotatably fitted into the circular passage; and a passage heat-insulating member made of an insulating material, the passage heat-insulating member covering at least a portion of a passage wall surface which forms the communication passage, and rotation of the cylindrical member being prevented by engaging the passage heat-insulating member with the cylindrical member, wherein the cylindrical member has a communication hole which is in communication with the communication passage, and wherein the passage heat-insulating member is fitted into the communication hole of the cylindrical member.

2. The heat-insulating mechanism according to claim 1, wherein the cylindrical member is loosely fitted into the circular passage.

3. The heat-insulating mechanism according to claim 1, wherein the compressor is a piston type in which the compression chamber is formed in a cylinder bore formed in a cylinder by accommodating a piston in the cylinder bore, the piston is reciprocated in the cylinder bore by rotation of a rotary shaft, and the suction pressure region and the discharge pressure region are formed in a cover housing connected to the cylinder, the cover housing forming the circular passage and the communication passage.

4. The heat-insulating mechanism according to claim 3, wherein the suction pressure region is located on an outer peripheral side of the cover housing and surrounds the discharge pressure region around an axis of the rotary shaft.

5. The heat-insulating mechanism according to claim 3, wherein the communication passage includes: a first communication passage intersecting the circular passage for connection therewith; and a second communication passage located downstream of a connecting portion between the circular passage and the first communication passage, the second communication passage intersecting the circular passage for connection therewith.

6. The heat-insulating mechanism according to claim 5, wherein an internal passage of the cylindrical member includes a first passage and a second passage having a smaller diameter than the first passage, the second passage being located downstream of the first passage, the first communication passage being in communication with the first passage, the second communication passage being in communication with the second passage.

7. The heat-insulating mechanism according to claim 5, further comprising: a seal ring located upstream of a connecting portion between the first communication passage and the circular passage, and between an outer peripheral wall surface of the cylindrical member and a peripheral wall surface forming the circular passage so as to surround the cylindrical member.

8. The heat-insulating mechanism according to claim 3, further comprising: a suction chamber provided in a portion of the suction pressure region, the suction chamber being located downstream of the communication passage to be in communication with the communication passage; and a chamber heat-insulating member made of an insulating material, the chamber heat-insulating member covering at least a portion of a wall surface for forming the suction chamber, the chamber heat-insulating member and the passage heat-insulating member being integrally formed.

9. The heat-insulating mechanism according to claim 1, wherein the refrigerant gas is carbon dioxide.

* * * * *